US005371980A

United States Patent [19]

Dix

[11] Patent Number: 5,371,980

[45] Date of Patent: Dec. 13, 1994

[54] SHOWER LINER

[76] Inventor: Steven J. Dix, 15912 - 106A Avenue, Edmonton, Alberta, Canada

[21] Appl. No.: 21,673

[22] Filed: Feb. 24, 1993

[51] Int. Cl.[5] ..... A47K 3/22

[52] U.S. Cl. ..... 52/34; 52/35; 52/389; 4/613; 4/DIG. 18

[58] Field of Search ..... 52/34 OR, 79.1, 630, 52/265, 169.14, 35, 98, 100, 390, 389, 443; 4/612, 613, DIG. 18

[56] References Cited

U.S. PATENT DOCUMENTS

| | | | |
|---|---|---|---|
| 2,484,240 | 10/1949 | Morthland | 4/613 |
| 2,757,385 | 8/1956 | Whittick | 4/613 |
| 2,853,714 | 9/1958 | Darmstadt | 4/DIG. 18 |
| 3,045,254 | 7/1962 | Cook et al. | 4/DIG. 18 |
| 3,895,398 | 7/1975 | Mustee | 4/613 |
| 3,938,200 | 2/1976 | Roberts et al. | 4/DIG. 18 |
| 3,992,825 | 11/1976 | May | 52/389 |
| 4,221,303 | 9/1980 | Yoshimura et al. | 52/265 |
| 4,316,295 | 2/1982 | Whitney et al. | 52/34 |
| 4,551,870 | 11/1985 | Presti, Jr. | 52/389 |
| 4,602,393 | 7/1986 | Fiveash | 4/DIG. 18 |

*Primary Examiner*—Carl D. Friedman
*Assistant Examiner*—Wynn E. Wood
*Attorney, Agent, or Firm*—Anthony R. Lambert

[57] ABSTRACT

A shower liner for use with ceramic tile consisting of a shell for polymer plastic body having a substantially flat bottom and a peripheral sidewall extending upwardly from the bottom.

1 Claim, 2 Drawing Sheets

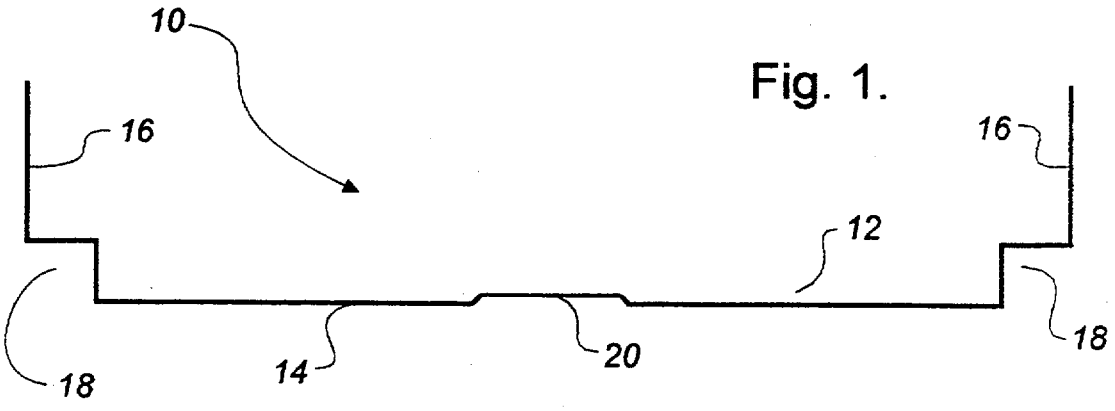
Fig. 1.
Fig. 2.
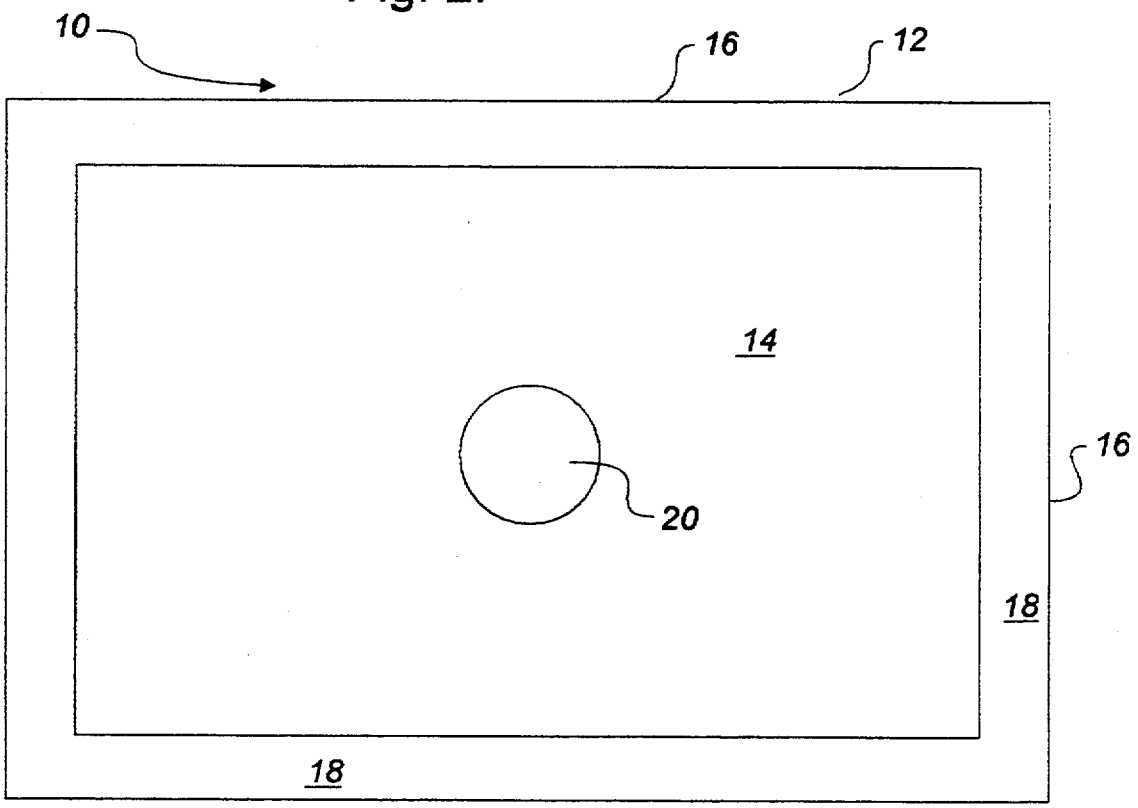

SHOWER LINER

BACKGROUND OF THE INVENTION

There is a widespread misconception that once a ceramic tile floor is in place all water will be shed by the slope leading to the drain and will be removed via the drain. What is not understood is that, in fact, there is a substantial penetration of water through the grout into the mortar bed under the ceramic tile. The usage of the shower will determine how dry or wet the mortar bed will remain. Drains used with ceramic tile typically have small holes in communication with the mortar bed to release excess water. A liner must be placed under the mortar bed to prevent excess water from escaping and causing damage to the building.

In order to save time and expense attempts were made to place rigid polymer plastic bases preformed with sloped drainage under ceramic tile in lieu of building up and shaping a mortar bed. These preformed bases were found to have a number of disadvantages. There was no latitude for positioning the drain, the drain could only be positioned where an opening was left in the preformed polymer plastic base. There was a differential in expansion and contraction as between ceramic tile and the polymer plastic base. There was no adhesive cement able to accommodate or withstand the relative movement between the ceramic tile and the polymer plastic base resulting from the differential in expansion and contraction. The industry was forced to return to using shower liners whenever a ceramic tile floor was called for.

The shower liners that are presently in widespread use with ceramic tile consist of a one piece flexible membrane of polyvinylchloride approximately 30 millimetres in thickness. The flexible membrane is purchased in rolls approximately 4 feet wide and 50 feet long. It is rolled out to a desired length and cut to suit the dimensions of the mortar bed, allowing for a portion to be run up all walls adjacent the mortar bed to a height of approximately 6 inches. These shower liners have a number of inherent problems. Depending upon the dimensions of the mortar bed it may be necessary to over lap material and seal the same to form a water tight seam. The liner is fit in loose formation, tacked to studs along its peripheral top edge and folded at the corners. Bulges and wrinkles of excess material on walls and floor can create problems during installation. These bulges and wrinkles prevent ceramic tile backer board from fastening flush. It is difficult to compact cement over the bulges and wrinkles, these areas are weaknesses in the floor which are susceptible to cracks. After construction water can become trapped in the bulges and wrinkles leading to mildew problems. In a high percentage of cases leaks are discovered in the shower liner after installation. The only way the leaks can be discovered is through frequent usage. When the shower is used frequently the water level in the mortar bed is high. Accumulations of water escape into walls and ceilings if there is a leak which provides secondary drainage. In such a case, the building owner is fortunate if the leak is discovered before substantial water damage is sustained. The only mode of repair is total replacement of the ceramic tile, mortar bed and liner. A pin hole in the liner is virtually impossible to locate by visual inspection during installation. However, water leaking through such a pin hole can cause substantial damage. The reason damage to shower liners is so common is due to the large number of tradesmen who are involved in building construction working in and around the shower area. The construction of a bathroom in which the ceramic shower is to be installed involves drywallers, plumbers, electricians, and others. Other than the tile setter, few tradesmen are aware of the importance of the shower liner, and the consequences if it sustains a pin hole. Trades entering the shower area frequently damage the shower liner through carelessness. The carelessness can involve dropping a tool onto the liner, or dropping small sharp objects onto the shower liner and stepping on them. Nails and screws are dropped and stepped upon by framers and drywallers. Wires are snipped and stepped upon by electricians. All trades tend to place garbage and other objects in the shower area to get them out of the way when they are working.

SUMMARY OF THE INVENTION

What is required is an improved form of shower liner for use with ceramic tile.

According to the present invention there is provided a shower liner for use with ceramic tile which is comprised of a shell form polymer plastic body having a substantially flat bottom and a peripheral sidewall extending upwardly from the bottom.

Although beneficial results may be obtained through the use of the shower liner, as described, framing defects at floor level such as twisted lumber and protruding nails often create problems during installation. In addition, when installing a backer board in the shower area drywallers have a tendency to put nails through the shower liner. These nails through the shower liner will create a leak if they are below drain level. When the shower is in usage, a differential in temperature on opposite sides of adjacent walls can result in condensation forming between the shower liner and the wall. Even more beneficial results may be obtained, for all of the above mentioned reasons, by having a recessed channel adjacent the bottom and the sidewall of the shell form body.

Although beneficial results may be obtained through the use of the shower liner, as described, a drain must always be positioned in the bottom of the shell form liner. In most cases the drain is centrally positioned. Even more beneficial results may, therefore, be obtained by having a pierceable membrane on the bottom which is of a thinner polymer plastic material than the bottom. The membrane indicates the preferred drain position, and is easily cut away to permit installation of the drain.

Although beneficial results may be obtained through the use of the shower liner, as described, even more beneficial results may be obtained with a raised pierceable membrane. The pierceable membrane can be convex. This assists in sealing the drain area.

BRIEF DESCRIPTION OF THE DRAWINGS

These and other features of the invention will become more apparent from the following description in which reference is made to the appended drawings, wherein:

FIG. 1 is a side elevation view in longitudinal section of a shower liner constructed in accordance with the teachings of the present invention.

FIG. 2 is a top plan view of the shower liner illustrated in FIG. 1.

DETAILED DESCRIPTION OF THE PREFERRED EMBODIMENT

Figure 3:
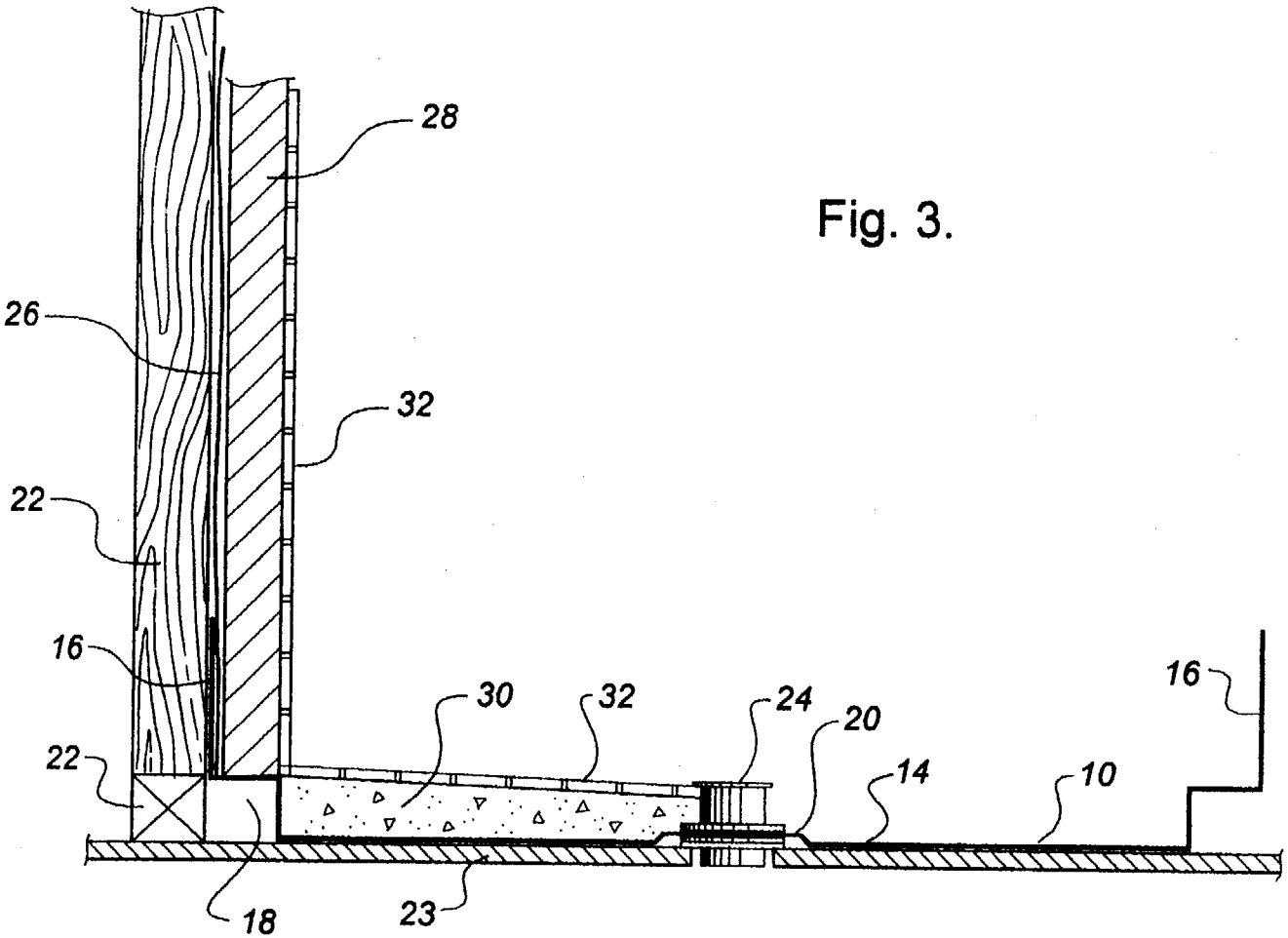
FIG. 3 is a side elevation view in longitudinal section of a shower installation using the shower liner illustrated in FIG. 1.

The preferred embodiment, a shower liner for use with ceramic tile generally identified by reference numeral 10, will now be described with reference to FIGS. 1 through 3.

Referring to FIGS. 1 and 2, shower liner 10 has a generally rectangular shell form polymer plastic body 12. Shell form body 12 has a substantially flat bottom 14 and a peripheral sidewall 16 which extends upwardly from bottom 14. A recessed channel 18 is positioned adjacent bottom 14 and sidewall 16. A raised convex pierceable membrane 20 is positioned on bottom 14. Membrane 20 is of a thinner polymer plastic material than bottom 14.

The use and operation of shower liner 10 will now be described with reference to FIG. 3. FIG. 3 illustrates shower liner 10 installed in a shower having ceramic tile. Prior to shower liner 10 being installed a frame 22, usually of wood construction is put in place on subfloor 23. Shower liner 10 is then placed immediately adjacent frame 22. The presence of recessed channel 18 accommodates any framing defect at floor level which might otherwise present a difficulty during installation. Membrane 20 indicates a preferred position of a drain 24. Construction of the shower area is completed by various tradesmen by placing over frame 22 and portions of shower liner 10 a thin polymer plastic vapour barrier 26 and backer board 28. A plumber installs drain 24, and all incidental plumbing. An electrician installs shower lighting (not shown). The tile setter places a mortar bed 30 on bottom 14 of shower liner 10 and slopes mortar bed 30 toward drain 24. Ceramic tile 32 is then placed on mortar bed 30.

Shower liner 10, being made of polymer plastic material of sufficient thickness to form a self supporting shell form body, is better able to withstand abuse from tradesmen. Being integrally formed it has no seams which might be prone to leakage and has no folds which might adversely effect the integrity of mortar bed 30 or trap water in stagnant pools. The presence of recessed channel discourages any drywaller or other tradesman from placing a nail through the liner below drain level. The addition of membrane 20 makes it easier to position drain 24. When it is desired to position drain 24, other than where membrane 20 is located, a hole can be cut directly through bottom 14. Using a raised convex form of membrane 20 makes it easier to seal around drain 24. After installation when the shower is in use, recessed channel 18 provides an air flow passage which reduces the likelihood of problems arising due to condensation.

It will be apparent to one skilled in the art that modifications may be made to the illustrated embodiment without departing from the spirit and scope of the invention as defined by the Claims.

The embodiments of the invention in which an exclusive property or privilege is claimed are as follows:

1. A combination shower liner and ceramic tile floor, comprising:

a. a rectangular shell form polymer plastic body having a flat bottom portion unencumbered by folds and protrusions thereby providing a mortar bed receiving surface devoid of water traps and a peripheral sidewall extending upwardly from the bottom:

b. a recessed channel adjacent the bottom and the sidewall;

c. a raised convex pierceable membrane on the bottom which is of a thinner polymer plastic material than the bottom, the membrane designating a preferred drainage position;

d. a mortar bed on the bottom of the body with the raised convex membrane exposed above the mortar bed; and e. a ceramic tile covering secured to the mortar bed thereby forming a finished floor.

* * * * *